US005613451A

United States Patent [19]

Zook

[11] Patent Number: 5,613,451

[45] Date of Patent: Mar. 25, 1997

[54] REMOVABLE HOPPER COVER

[75] Inventor: Jon C. Zook, Hendersonville, Tenn.

[73] Assignee: Illinois Tool Works Inc., Glenview, Ill.

[21] Appl. No.: 440,648

[22] Filed: May 15, 1995

[51] Int. Cl.[6] ..... F23M 7/00

[52] U.S. Cl. ..... 110/173 R; 432/250; 49/463; 49/465; 220/340

[58] Field of Search ..... 110/173 R, 173 A, 110/173 B; 432/250; 49/463, 465; 220/335, 340, 343

[56] References Cited

U.S. PATENT DOCUMENTS

| | | | |
|---|---|---|---|
| 2,117,228 | 5/1938 | Stuchbery | 220/340 |
| 2,371,785 | 3/1945 | Tozer | 110/173 R |
| 4,099,648 | 7/1978 | Kirkton | 220/340 |
| 4,967,924 | 11/1990 | Murofushi et al. | 220/335 X |
| 5,327,682 | 7/1994 | Holtz | 49/463 X |

*Primary Examiner*—Edward K. Look
*Assistant Examiner*—Michael S. Lee
*Attorney, Agent, or Firm*—Dvorak and Traub

[57] ABSTRACT

An apparatus for covering the hopper of a material melting and dispensing apparatus is disclosed. The apparatus includes a cover lid engageable with a cover base. A hinge arrangement allows pivoting between the cover lid and cover base, and also allows for non-destructive removal of the cover lid from the cover base upon over-extension of the cover lid in the open direction.

5 Claims, 5 Drawing Sheets

REMOVABLE HOPPER COVER

BACKGROUND OF THE INVENTION:

1. Field of the Invention

This invention relates generally to an apparatus for receiving thermoplastic and other hot melt materials and adhesives, melting the material and supplying the material to a dispenser. In particular, this invention relates to a removable cover for the hopper element of such an invention. The hopper cover is removable and is resistant to breakage due to misuse and over-extension in the open position.

2. Description of the Related Art

In the past, hoppers for hot melt materials, such as thermoplastics and adhesives, included no cover, or basic covers without special features. Due to the nature of hot melt processing, and the characteristics of hot melt materials, many disadvantages become apparent in the prior art.

For example, basic non-hinged removable covers were in practice inconvenient, subject to being misplaced and difficult to manipulate after exposure to and contamination by hot melt materials. Tight fitting covers become difficult to remove after contamination, and loose fitting covers allowed for excessive spillage of materials and byproducts.

Improvements in the form of hinged type covers solved some of the problems associated with non-hinged covers. However, certain problems remained. For example, prior art hinged covers were susceptible to breakage when over-extended in the open direction. Also, condensation and other by-product buildup on the inside of the cover would tend to spill outside of the hopper upon opening of the cover.

The problems associated with hopper covers, particularly relating to breakage and drainage of by-products, have not been addressed or solved in the prior art.

It is therefore an object of the present invention to provide an improved hopper cover for hot melt apparatus. Specifically, it is an object of the present invention to provide an improved hopper cover which is resistant to breakage upon over-extension. It is a further object of the present invention to provide an improved hopper cover which controls and directs condensation and other by-products of the melting process back into the hopper, thereby avoiding spillage outside of the hopper, or contamination of the hopper cover mechanism or other parts. These and other objects are achieved through the present invention.

It is yet another object of the invention to provide a breakaway feature should the cover become adhered, in the closed position, to a top section of the hopper.

DESCRIPTION OF THE PREFERRED EMBODIMENTS

Figure 1:
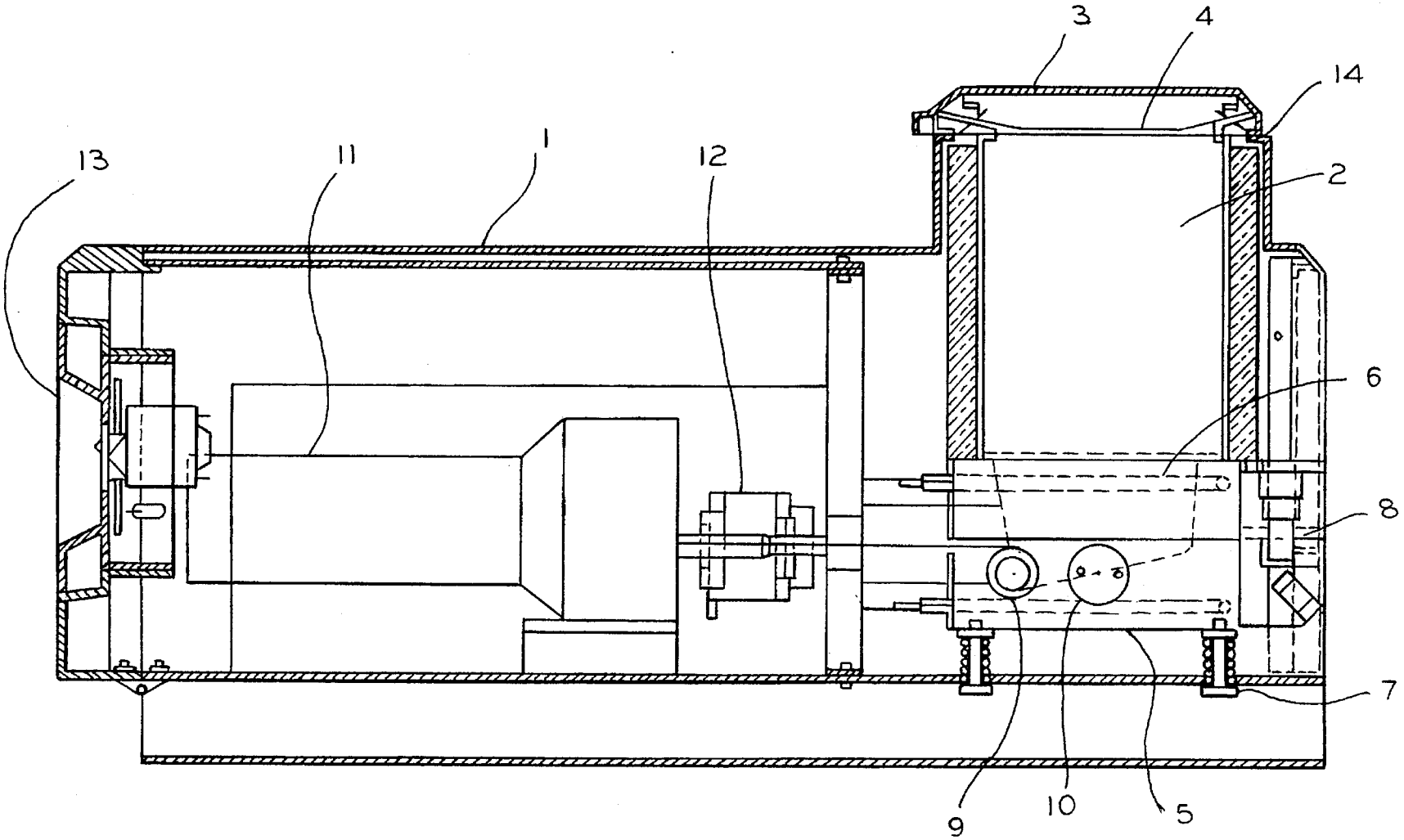
FIG. 1 is a side view of the present invention illustrating the entire melting/dispensing apparatus.

Referring to the drawings, FIG. 1 shows a material melting and dispensing apparatus 1 having a material hopper 2, cover lid 3, diverter 4, and cover base 14. Solid and quasi-solid material to be melted, such as hot melt adhesive pellets, are added to the hopper 2. Heat is supplied to the melter body 5 through the upper and lower heating elements 6 and 7. The melted material is drawn through the shut-off valve and filter 9 and is subsequently pumped by pumping means, the pumping means being driven by the prime mover 11 through the coupling 12. Feedback is provided by the temperature sensing means 10, and control of the process is maintained by the control panel 13. The material is dispensed as needed through the shut-off valve/filter 9 and eventually through the dispensing means 8.

Figure 2:
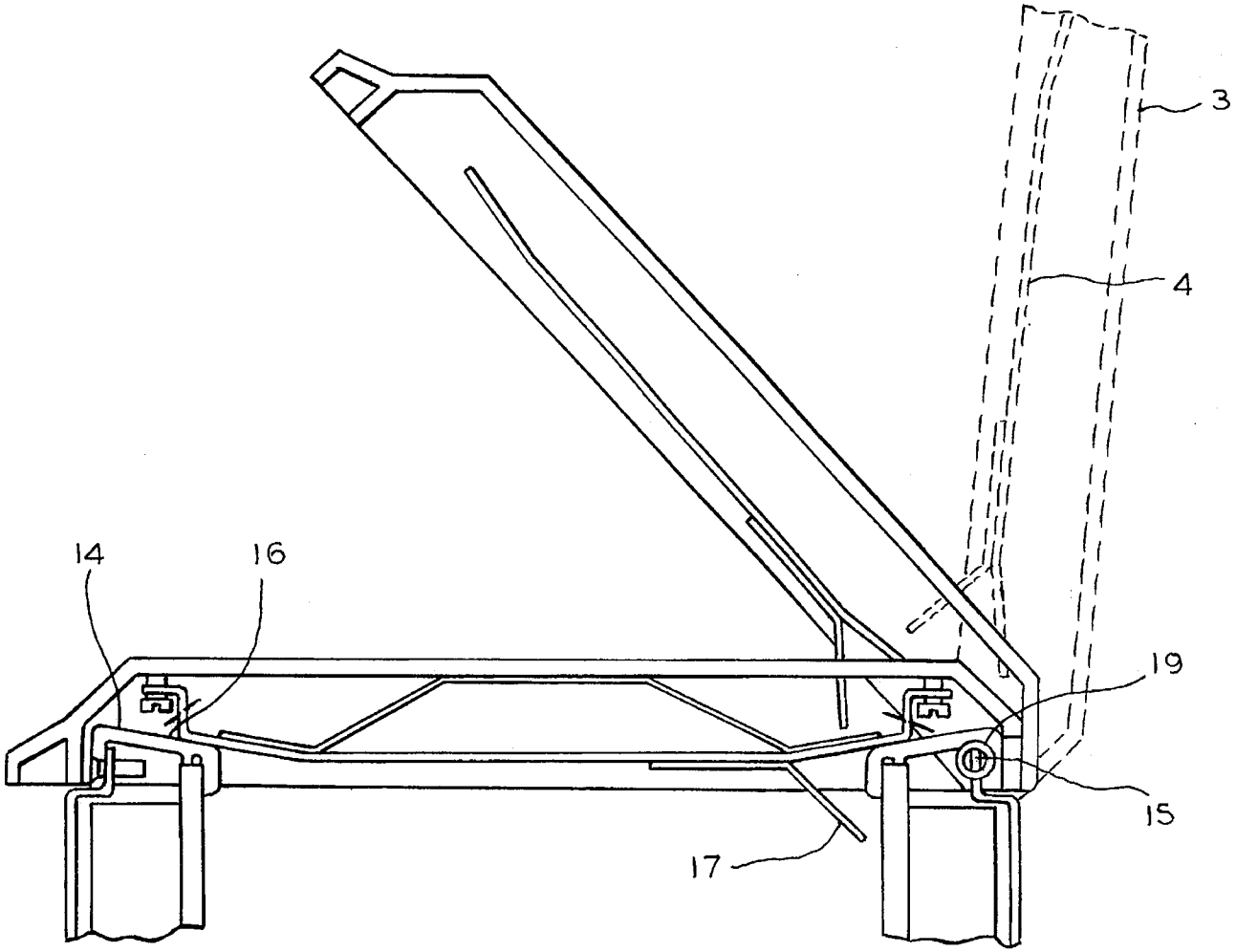
FIG. 2 is a side view of the cover lid and diverter in three positions.

Referring now specifically to the cover assembly and related apparatus, FIG. 2 shows the cover lid 3, which may be formed of plastic, stainless steel, or other material generally unaffected by corrosive hot melt materials. Attached to or a part of the cover lid may be a diverter 4. The diverter 4 is arranged to collect condensation and other byproducts of the melting process, and control the return of those by-products back to the hopper 2. The diverter 4 may have a diverter extension 17, near the hinge point of the lid/base assembly, which is arranged to ensure that by-products are directed away from the hinge area and back into the hopper 2. Also, the diverter 4 may function as a breakaway panel in the event of a stuck lid. The cover lid 3 may be pivoted 90° and beyond from its closed horizontal position. When the cover lid 3 is over-extended beyond approximately 90° from horizontal, the cover lid 3 disengages without damage from the cover base 14.

Figure 3:
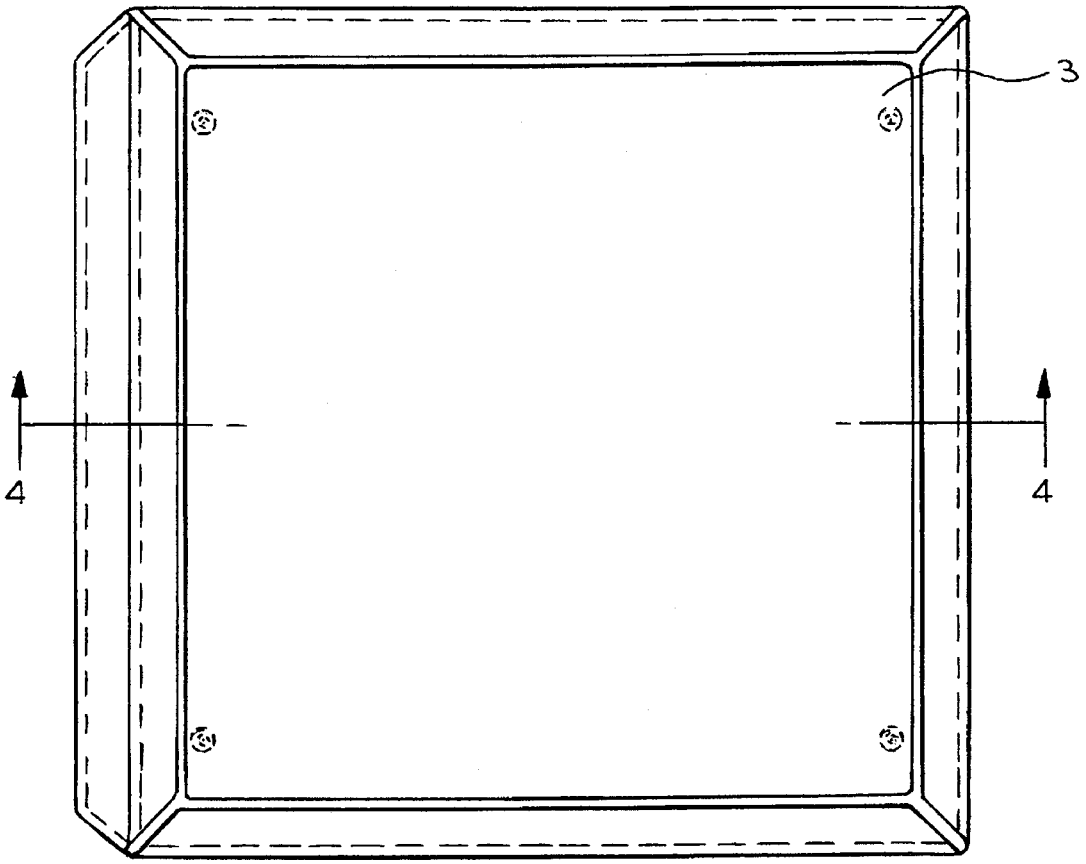
FIG. 3 is a plan view of the cover lid.

Referring to FIG. 3, the top of the cover lid 3 is shown, in this embodiment having sloped edges. The external shape of the cover lid 3 may take many different forms.

Figure 4:
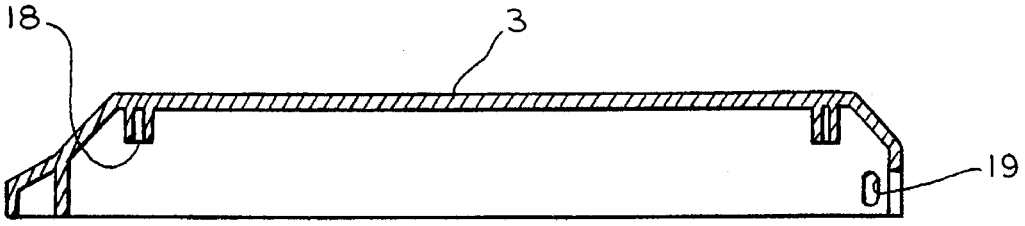
FIG. 4 is a cross-sectional view of the cover lid taken at line A—A of FIG. 3.

FIG. 4, a cross-sectional view of the cover lid 3 taken at line A—A of FIG. 3, illustrates one embodiment. Here, diverter attachment points 18 are shown, along with cover lid hinge points 19, which may take the form of orifices or depressions in the cover lid 3.

Figure 5:
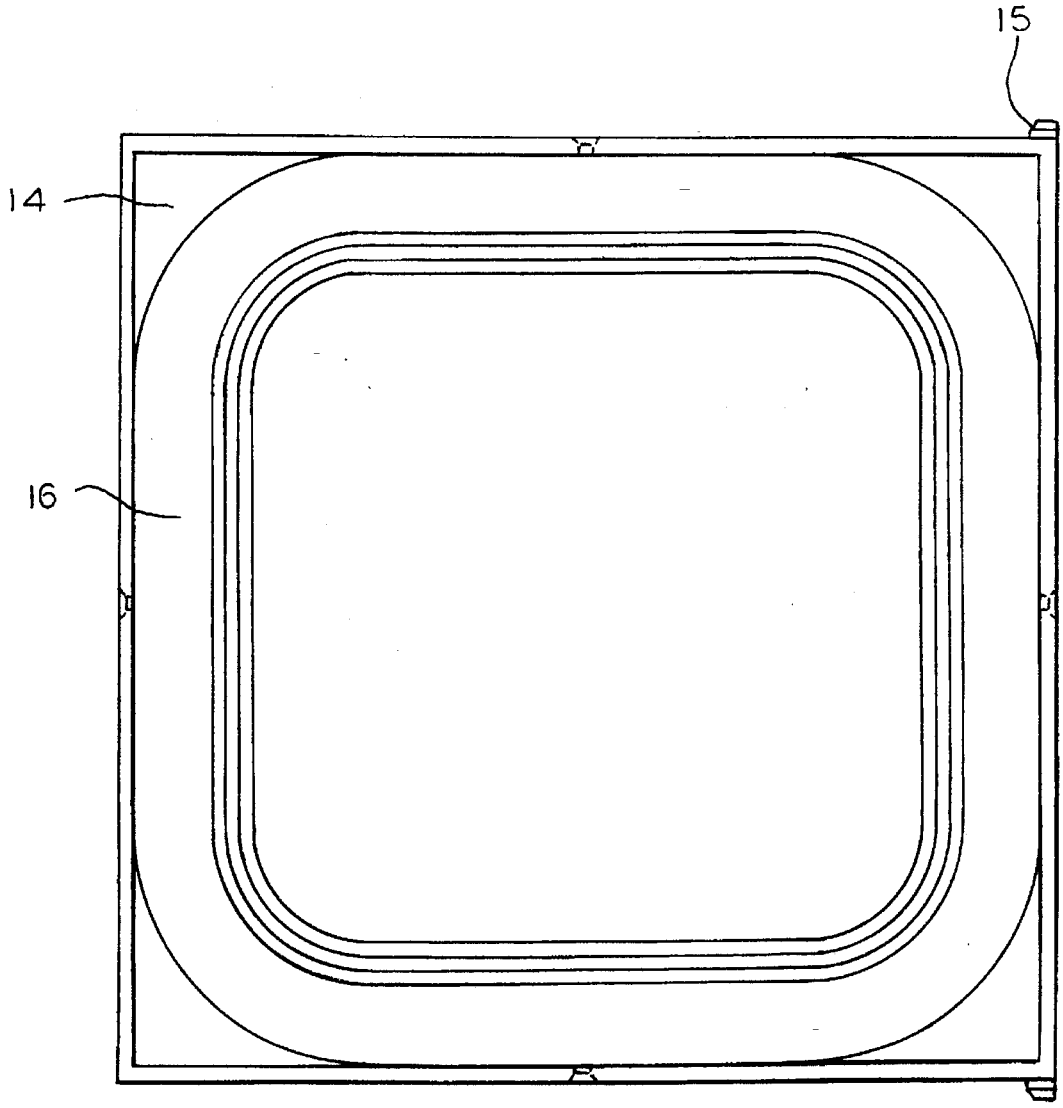
FIG. 5 is a plan view of the cover base.

The cover base 14 is shown in FIG. 5. In one embodiment, the cover base 14 has a cover base sloped lip 16 which facilitates the movement of material to be melted and by-products of melting, back into the hopper. Also illustrated are one embodiment of the cover base hinge pins 15, which are designed to mate with the cover lid hinge points 19. The cover base 14 may be formed of plastic, stainless steel, or other material generally impervious to corrosive hot melt materials. In one embodiment, the cover base fits over the top edges of the hopper 2, and is attached using standard fasteners.

Figure 6:
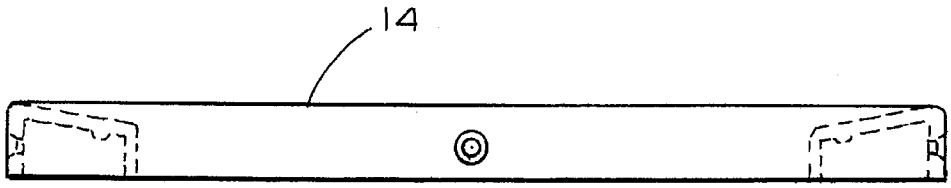
FIG. 6 is a side view of the cover base.

FIG. 6 illustrates the cover base 14 from one side, showing the slope of the cover base sloped lip 16, and the cover base hinge pins 15.

Figure 7:
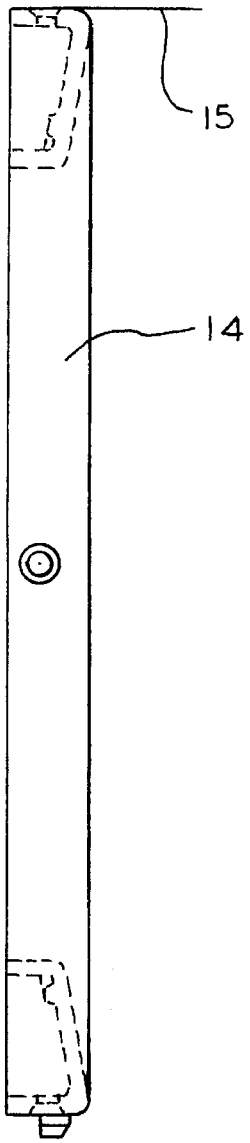
FIG. 7 is a side view of the cover base.

FIG. 7 illustrates the cover base from another side, showing the position of two cover base hinge pins 15.

Figure 8:
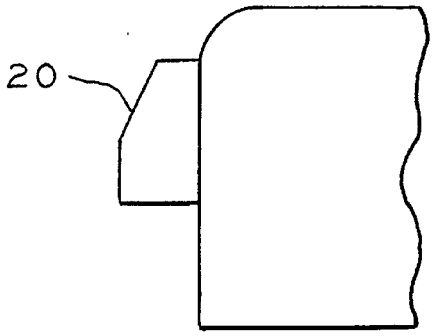
FIG. 8 is a detail view of the cover base hinge pin.
Figure 9:
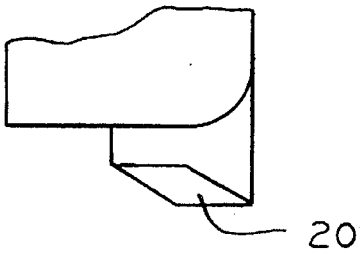
FIG. 9 is a detail view of the cover base hinge pin.
Figure 10:
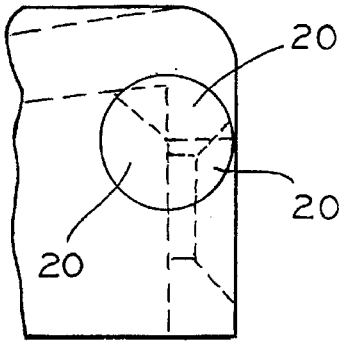
FIG. 10 is a detail view of the cover base hinge pin.

Details of the cover base hinge pins 15 are shown in FIGS. 8, 9, and 10. Specifically, it can be seen that in one embodiment, the cover base hinge pins 15 have a plurality of angled hinge pin detachment surfaces 20. Those beveled surfaces allow for the controlled movement of the area surrounding the cover lid hinge points 19 so that they disengage and slide over the cover base hinge pins 15 when the cover lid 3 is over-extended beyond approximately 90° from horizontal. The levered movement of the semi-flexible area surrounding the cover lid hinge points 19 causes a spreading of the area to accommodate the height of the cover base hinge pins 15, such that the cover base hinge pins 15 are removed from the cover lid hinge points 19, and the cover lid is freed from its original hinged arrangement with the cover base. The angles of the hinge pin detachment surfaces 20 facilitate the spreading of the material surrounding the cover lid hinge points 19, and allow detachment without breakage of any of the elements of the cover lid 3 or the cover base 14.

The ability of the cover lid to so detach is a great advantage in practice. With prior art lid/hinge arrangements, the leverage generated upon over-extending the cover lid, the fulcrum being generally large with respect to the dimensions of prior art hinge assemblies, would result in frequent breakage and would render useless those hinge assemblies. With the present invention, the cover lid 3 may simply be reinstailed after it has been forced off by over-extension, with no ill effect on the components. This cycle of removal and reinstallation may be repeated continuously without the need for repair or replacement of the cover lid 3 or cover base 14. This removable feature of the cover lid 3 also facilitates cleaning of the components.

A single preferred embodiment of the present invention is described above. However, those skilled in the art will appreciate the various modifications which could be made to the present invention without departing from the scope of the invention. The invention is therefore not limited except by the scope of the appended claims.

I claim:

1. A cover apparatus comprising:

a cover lid for covering a hopper of a device for melting and supplying a hot melt and an adhesive;

the cover lid having cover lid hinge points;

a cover base attachable to a top section of the hopper;

the cover base having cover base hinge means engageable with the cover lid hinge points; and detachment means, wherein upon over extension of the cover-lid, the cover lid hinge points disengage from the cover base hinge means and the cover lid disengages from the cover base without damage to any of the elements.

2. An apparatus for covering a hopper of a device for melting and supplying hot melt materials and adhesive comprising:

a cover lid;

the cover lid having cover lid hinge points;

a cover base attachable to a top section of the hopper;

the cover base having cover base hinge means engageable with the cover lid hinge points;

detaching means, wherein upon over-extension of the cover lid, the cover lid hinge points disengage from the cover base hinge means and the cover lid disengages from the cover base without damage to any of the elements; and a diverter attachable to the cover lid, wherein the diverter directs by-products of the heating process back into the hopper, away from the hinge areas of the apparatus.

3. An apparatus for covering a hopper of a device for melting and supplying hot melt materials and adhesive comprising:

a cover lid;

the cover lid having cover lid hinge points wherein the cover lid hinge points have orifices;

a cover base attachable to a top section of the hopper;

the cover base having cover base hinge means engageable with the cover lid hinge points wherein the cover base hinge means have cover base hinge pins engageable within the orifices;

detachment means, wherein upon over-extension of the cover lid, the cover lid hinge points disengage from the cover base hinge means and the cover lid disengages from the cover base without damage to any of the elements; and a hinge pin detachment surface located on the cover base hinge pins, wherein the hinge pin detachment surface has a plurality of angled surfaces which facilitate the spreading of and area adjacent the cover lid hinge points during over-extension of the cover lid in the open direction, wherein the cover lid hinge points disengage from the cover base hinge means and the cover lid disengages from the cover base without damage to any elements.

4. An apparatus for covering a hopper of a device for melting and supplying hot melt materials and adhesive according to claim 3, wherein the cover base has a cover base sloped lip, the lip sloping inwards toward the bottom of the hopper, wherein material is directed from the lip down into the hopper.

5. An apparatus according to claim 2, wherein the diverter is arranged and constructed to break away from the cover lid upon adhesive attachment of the diverter to the cover base.

* * * * *